United States Patent [19]

Crankshaw

[11] Patent Number: 4,473,429

[45] Date of Patent: Sep. 25, 1984

[54] HIGH SPEED WRAP AROUND LABEL APPLICATOR AND METHOD

[75] Inventor: Michael Crankshaw, Santa Fe Springs, Calif.

[73] Assignee: Label-Aire Inc., Fullerton, Calif.

[21] Appl. No.: 425,422

[22] Filed: Sep. 28, 1982

[51] Int. Cl.[3] ..... B65C 3/04

[52] U.S. Cl. ..... 156/483; 156/212; 156/215; 156/364; 156/443; 156/468; 156/485; 156/486; 156/497; 156/567; 156/DIG. 40

[58] Field of Search ..... 156/497, 566, 567, 364, 156/443, 483, 485, 481, 486, 487, 488, 213, 215, 468, DIG. 40, DIG. 42

[56] References Cited

U.S. PATENT DOCUMENTS

| | | | |
|---|---|---|---|
| 3,707,417 | 12/1972 | Dullinger | 156/215 |
| 3,984,277 | 10/1976 | French et al. | 156/497 |
| 4,046,613 | 9/1977 | Kucheck et al. | 156/497 |
| 4,108,709 | 8/1978 | Hoffman | 156/215 |
| 4,124,429 | 11/1978 | Crankshaw | 156/449 |
| 4,272,311 | 6/1981 | D'Angelo et al. | 156/215 |
| 4,306,926 | 12/1981 | Pfulb | 156/215 |
| 4,316,762 | 2/1982 | Martin | 154/488 |

*Primary Examiner*—Jay H. Woo
*Assistant Examiner*—Timothy W. Heitbrink
*Attorney, Agent, or Firm*—Gordon L. Peterson

[57] ABSTRACT

A label applicator for applying labels to articles which are moved along an article path comprising a conveyor having first and second conveyor sections on opposite sides of the article path and a label dispenser for dispensing labels onto the conveyor. The conveyor conveys the labels to a label retaining station at which the label spans the space between the first and second conveyor sections. An article to be labeled is moved along the article path between the first and second conveyor sections so the article contacts a central region of the label as it passes through the label retaining station. This adheres a central region of the label to the article. The end portions of the label are pressed against the article downstream of the label retaining station.

12 Claims, 8 Drawing Figures

HIGH SPEED WRAP AROUND LABEL APPLICATOR AND METHOD

BACKGROUND OF THE INVENTION

Wrap around label application typically involves wrapping a label around, or part way around, the peripheral wall of an article. In order to wrap the label around the article, the article is usually rotated during label application.

Labels are usually provided by adhesively attaching them to an elongated backing strip. The labels are sequentially removed by moving the backing strip over a peeling bar. The labels are releasably retained on a grid adjacent the peeling bar by applying subatmospheric pressure to one side of the grid.

For conventional wrap around label application, the grid releasably retains the removed label adjacent a wrap around belt. The article to be labeled is moved by a conveyor into contact with one end of the label at a labeling station, and the article is rotated as it moves through the labeling station to wrap the label around the article. One such wrap around label applicator is shown in French et al U.S. Pat. No. 3,984,277.

It is also known to use a label transport for transporting labels between the grid and the wrap around station. Such a construction is shown in Crankshaw U.S. Pat. No. 4,124,429. Subatmospheric pressure can be applied to the transport to hold the labels against the transport while the labels are being moved, and such a construction is shown in Kucheck et al U.S. Pat. No. 4,046,613.

In order to be able to wrap a label around an article, labels used for wrap around purposes are often elongated. In conventional wrap around labeling, the label is held at one end and the article to be labeled contacts such label at one end of the label only. A typical requirement for wrap around labeling is that the longitudinal axis of the label directly overlie a reference line on the article to be labeled. Unfortunately, if the label is retained at the wrap around station in a position which is slightly skewed relative to the reference line on the article, the longitudinal axis at the remote end of the label may be spaced significantly from the reference line. This is particularly unacceptable when the label is to be applied, for example, in a circumferentially extending groove on the article.

SUMMARY OF THE INVENTION

This invention provides a wrap around label applicator and method which applies the label more accurately than has been possible heretofore and obtains other noteworthy advantages. With this invention, the longitudinal axis of the label at the end portions of the label is displaced a smaller amount from the reference line on the article than with prior art wrap around applicators.

To reduce the maximum offset between the longitudinal axis of the label and the reference line on the article, this invention provides for initial contact between the label and the article at a central region of the label as the article passes through the station at which the label is retained. Accordingly, a central region of the label is initially adhered to the article, and the end portions of the label are not adhered to the article. Subsequently, the end portions of the labels are urged against the article to adhere such end portions to the article.

With this method, the distance between the initially adhered portion of the label and each of the end portions of such label is approximately one half the length of the label, whereas, with conventional wrap around techniques, the distance between the initially adhered end portion and the free end portion is approximately equal to the length of the label. Accordingly, for a given degree of angular misalignment between the longitudinal axis of the label and the reference line, the amount of offset between these lines at the end portions of the label is cut in half. By reducing this error by a factor of approximately 2, the label end portions are more likely to be applied to the article within the allowable tolerances, such as within an annular groove on the article periphery.

It is preferred to retain the label at the label retaining station at first and second locations which are spaced apart by the central region of the label. The label can be advantageously and accurately transported to this position by a label transport in the form of a conveyor.

The conveyor advantageously includes first and second conveyor sections on opposite sides of the article path for retaining the label at first and second locations. The label applicator also includes means for dispensing labels onto the conveyor at a location spaced from the label retaining station. The conveyor transports the labels from such location to the label retaining station. The conveyor can rapidly transport the label to the label retaining station. In addition, by providing stops for the label at the label retaining station and running the conveyor after the label contacts the stops, precise alignment of the longitudinal axis of the label with the reference line is much more likely to occur.

The end portions of the label can be pressed against the article in various different ways. Although a conventional wrap around belt could be used, it is preferred to employ flexible elements, such as brushes or rotary elements having peripheral recesses for at least partially receiving the article to be labeled and pressing the label against such article. These techniques can be used with noncylindrical articles.

The elongated labels commonly used for wrap around label application have a longitudinal or major axis and a shorter minor axis which is transverse to the longitudinal axis. Typically, the labels are adhesively attached to an elongated web or backing strip. The labels are sequentially removed by moving the web over a peeling bar. This label dispensing function is relatively slow compared with other aspects of the labeling operation. Crankshaw U.S. Pat. No. 4,124,429 discloses a label applicator which increases labeling speed by utilizing labels having their longitudinal axes extending transversely of the web to which they are adhered and by removing the labels from the web in the direction of the minor axis of the labels. With this arrangement, a label can be removed from the web with a much shorter movement of the web.

This invention retains this advantage. In addition, with this invention the conveyor moves the dispensed label in the direction of the minor axis or dimension to the label retaining station. This can provide for a short label path, a relatively smaller conveyor or label transport, and a relatively short time to move the label from the position it occupies after being dispensed to the label retaining station.

The invention, together with additional features and advantages thereof, may best be understood by reference to the following description taken in connection with the accompanying illustrative drawing.

DESCRIPTION OF THE PREFERRED EMBODIMENTS

Figures 1, 1A, 2:
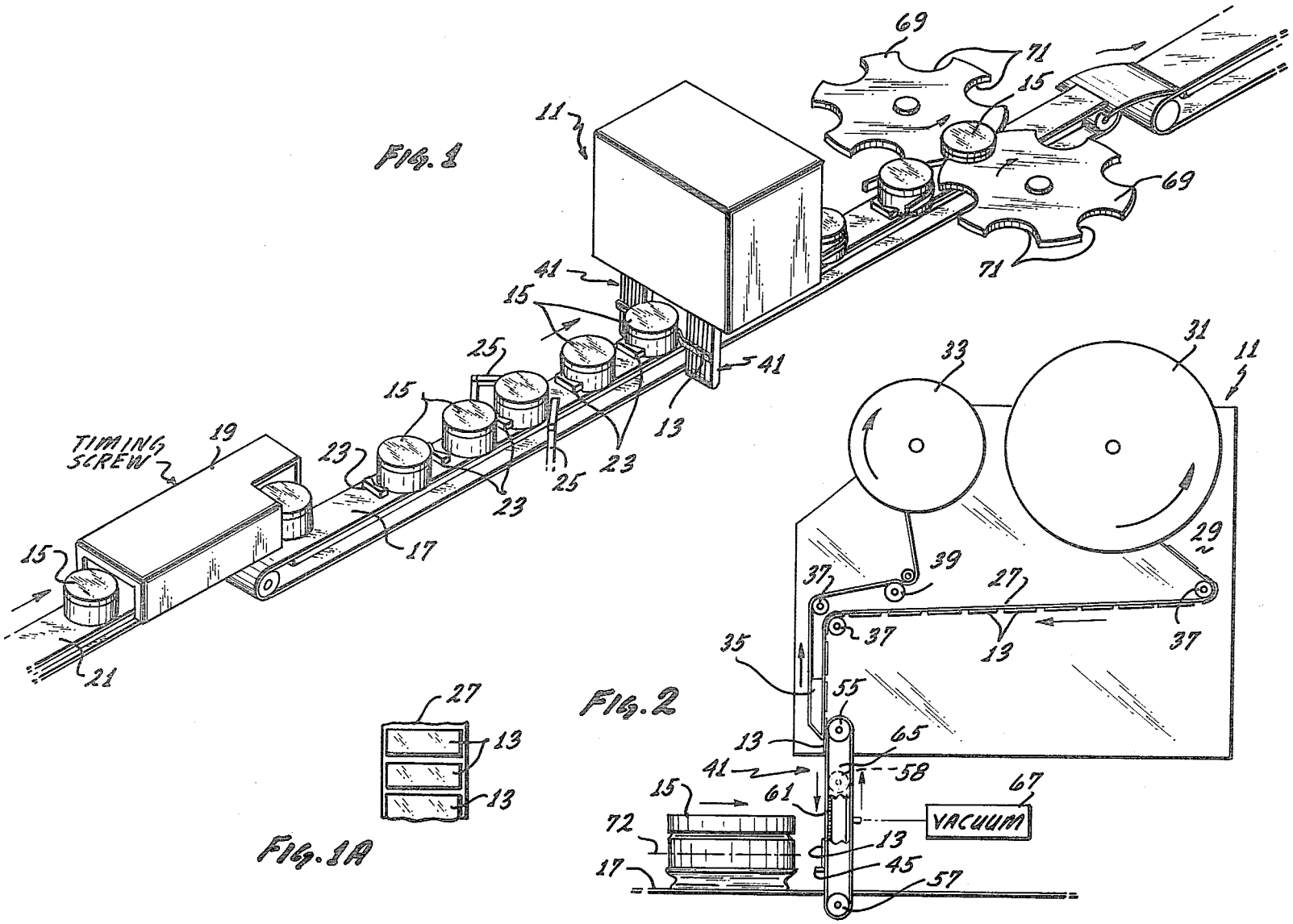
FIG. 1 is a somewhat schematic perspective view of a label applicator constructed in accordance with the teachings of this invention being used to apply labels to articles.
FIG. 1*a* is a fragmentary plan view of a strip of labels.
FIG. 2 is a somewhat schematic side elevational view of the label applicator.

FIG. 1 shows a label applicator 11 being used to apply labels 13 to articles 15 being conveyed along an article path and through a label retaining station by a conveyor 17. Although various constructions are possible, in the embodiment illustrated, the articles 15 are supplied at predetermined intervals to the conveyor 17 by a conventional timing screw 19 which receives the articles 15 from an input conveyor 21 and delivers them to the conveyor 17 in a predetermined time sequence. Timing screws, such as the timing screw 19, are known, and for this reason, the timing screw 19 is not described in detail herein.

The conveyor 17 runs at a predetermined speed and includes a plurality of equally spaced lugs 23 for engaging the articles 15, respectively, and moving them along in equally spaced relationship. To assure contact between the articles 15 and the lugs 23, the conveyor 17 moves the articles 15 through a conventional pivotable gate 25 which restrains the articles sufficiently to allow the lug 23 immediately behind each article to engage such article and thereafter push such article through the label applicator 11. Thus, the articles 15 are supplied to the label applicator 11 at regular intervals. Although the articles 15 can be of any configuration, in the embodiment shown in FIGS. 1–4, the articles 15 are cylindrical.

Although the labels 13 can be of various different kinds, in the embodiment illustrated, they are pressure sensitive adhesive labels releasably adhered to an elongated web or backing strip 27. The label applicator 11 comprises a supporting structure 29, a supply reel 31 on which a supply of the labels 13 is wound, a take-up reel 33, a peeler bar 35, guide rollers 37 for guiding the web 27 from the supply reel 31 over the peeler bar 35 to the take-up reel 33, and a label drive 39 in the form of a suitable pair of rollers for moving the web 27 from the supply reel to the take-up reel. All of these elements are suitably mounted on the supporting structure 29 and may be of conventional construction. Movement of the web 27 over the peeler bar 35 removes the labels 13 from the web.

Figure 3:
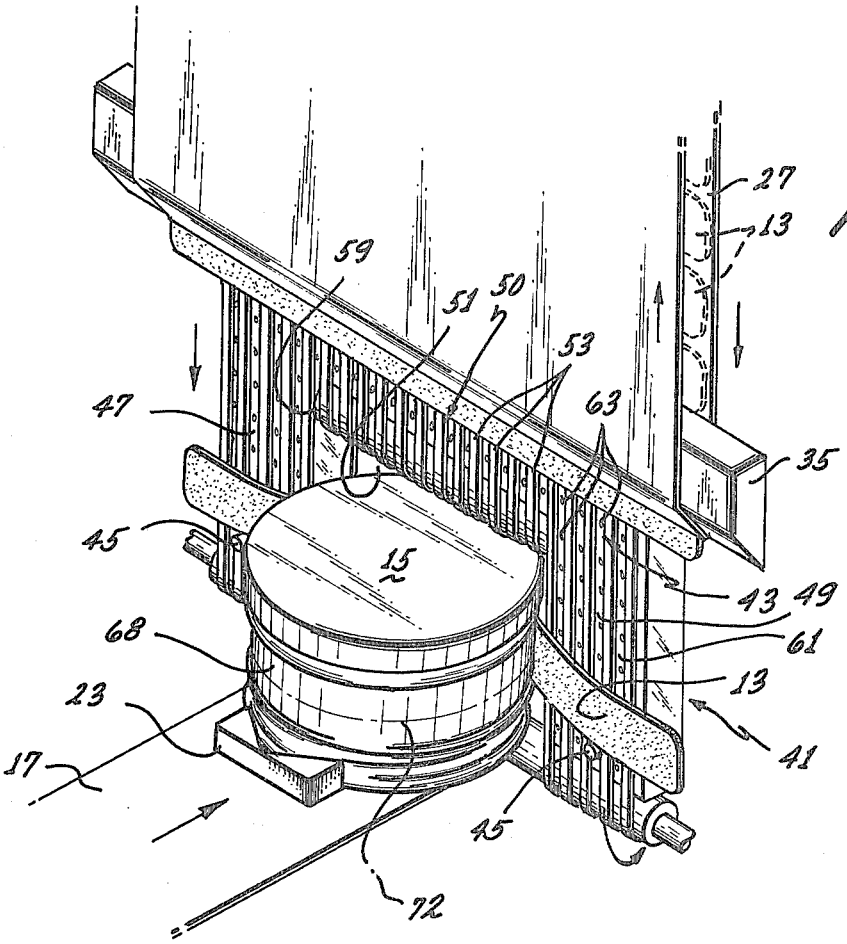
FIG. 3 is an enlarged fragmentary perspective view showing the initial contact between a label at a retaining station and the article to be labeled.

The removed labels 13 are deposited on a vacuum transport 41 (FIGS. 1–3). The vacuum transport includes a conveyor 43 for conveying the dispensed labels to the label retaining position and stop elements 45 (FIG. 3) for engaging and arresting movement of the label along the conveyor at the label retaining station. The conveyor includes identical conveyor sections 47 and 49 extending along opposite sides of the article path on opposite sides of a short conveyor section 50. More specifically, the surface of the conveyor 43 along which the labels 13 are transported extends perpendicular to the article path and to the conveyor 17. The conveyor sections 47 and 49 are spaced apart by the conveyor section 50 and a space 51 below the conveyor section 50 which is sufficiently wide to allow passage of the article 15 therethrough as shown in FIG. 3.

The vacuum transport 41 may be of the type shown and described in Kucheck at al U.S. Pat. No. 4,046,613. Generally, such a vacuum transport includes a plurality of spaced apart, endless conveyor belts 53 (FIG. 3) mounted on rollers 55 and 57 (FIG. 2) for the conveyor sections 47 and 49 and rollers 55 and 58 for the conveyor section 50. A plate 61 having apertures 63 is mounted within the endless belts 53 with the plate being adjacent the portions of the belts facing toward the oncoming articles 15. The plate 61 forms a portion of a housing 65 (FIG. 2) within the belts 53, and the interior of the housing 65 is subjected to a partial vacuum by a vacuum source 67. This partial vacuum creates a suction at the apertures 63 to releasably retain the label 16 on the conveyor 43.

The stop elements 45, which may be coupled to the housing 65, project outwardly through the spaces between adjacent conveyor belts 53 of the conveyor sections 47 and 49, respectively. In the embodiment illustrated, the stop elements 45 are both located the same amount above the conveyor 17 so as to accurately position the labels 13 at the label retaining station, with its longitudinal axis horizontal.

In use, the label drive 39 operates intermittently to sequentially dispense labels 13 onto the conveyor 43. As shown in FIG. 1*a*, each of the labels 13 has a major or longitudinal axis or dimension and a minor axis or dimension transverse to the major dimension. The labels 13 are arranged on the web 27 with their longitudinal axes perpendicular to the longitudinal axis of the web. Movement of the web 27 over the peeler bar 35 dispenses the label 13 onto the conveyor 43 in the direction of the minor axis or dimension of the label. The conveyor moves the label in the direction of the minor dimension to the label retaining station. The conveyor 43 runs continuously to transport each dispensed label downwardly into engagement with the stop elements 45 whereupon label movement is arrested and the label thereafter slips on the belts 53.

The conveyor 17 moves the article 15 through the label applying station as shown in FIG. 3 so that the article contacts a central region of the label 13 as the article passes through the label retaining station. This adheres the central region of the label to the peripheral wall 68 of the article, and end portions of the label are not adhered to the article.

Figure 4:
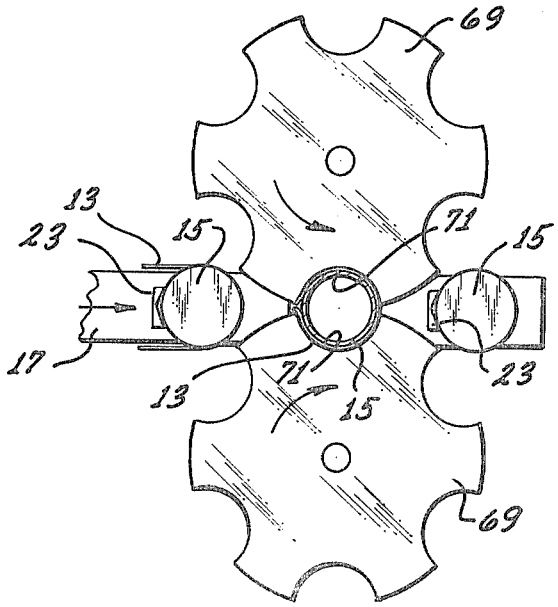
FIG. 4 is an enlarged fragmentary plan view showing the use of rotary elements for completing the application of the label to the article.

The end portions of the label 13 can be adhered to the article 15 in different ways. In the embodiment shown in FIGS. 1–4, this is accomplished by identical rotary elements 69 located downstream of the label retaining station and on opposite sides of the conveyor 17. Each of the rotary elements 69 has multiple peripheral recesses 71 for partially receiving the article 15 as shown in FIGS. 1 and 4. The rotary elements 69 are synchronously rotated in timed relationship with the conveyor 17, the articles 15 and to each other so that each of the articles 15 is partially received within opposed recesses 71 of the rotary elements as shown in FIG. 4 to press the end portions of the label 13 circumferentially around and into engagement with the article 15.

Because the stop elements 45 are provided, the label 13 is accurately held in the desired position relative to the article to be labeled. Furthermore, because the central region of the label 13 first contacts the article to be labeled, any angular misalignment between the longitudinal axis of the label and a reference line 72 (FIGS. 2 and 3) on the article along which the longitudinal axis should lie is minimized. The label drive 39 can dispense a second label onto the conveyor 43 at predetermined intervals or in response to a signal indicating that the previously dispensed label has been picked up by one of the articles 15.

Figure 5:
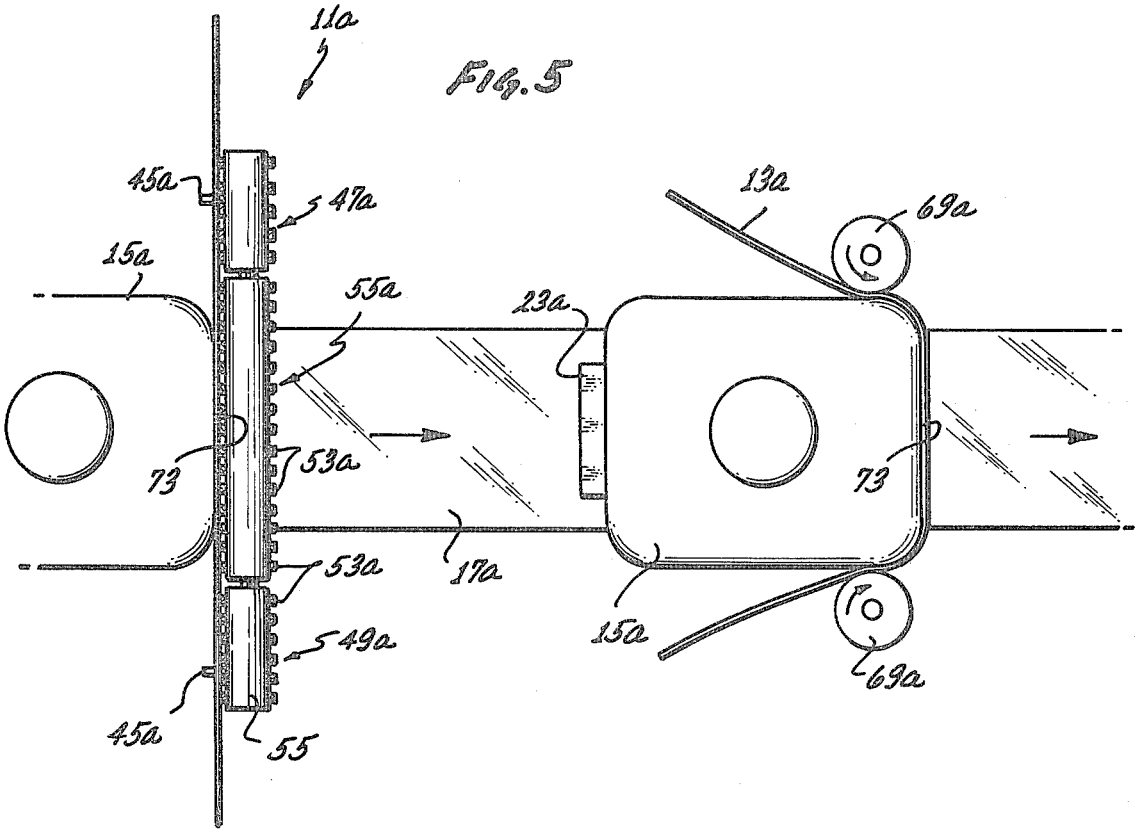
FIG. 5 is a plan view of a second embodiment of label applicator.

FIG. 5 shows a label applicator 11*a* which is identical to the label applicator 11 in all respects not shown or described above. Portions of the construction shown in FIG. 5 corresponding to portions of the construction shown in FIGS. 1–4 are designated by corresponding reference numerals followed by the letter "a."

The embodiment of FIG. 5 is particularly adapted for labeling of the article 15*a* which is generally in the form of a rectangular solid and has a leading face 73.

The label applicator 11*a* is identical to the label applicator 11, except that the former uses rotary elements 69*a* in the form of cylindrical rollers which do not have the recesses 71. The rollers 69*a* press portions of the label 13*a* outwardly of a central region against the sides of the article 15*a* as shown in FIG. 5. FIG. 5 also shows that the roller 55*a* may be divided into three sections, one for each of the conveyor sections 47*a*, 49*a* and 50*a*.

Figure 6:
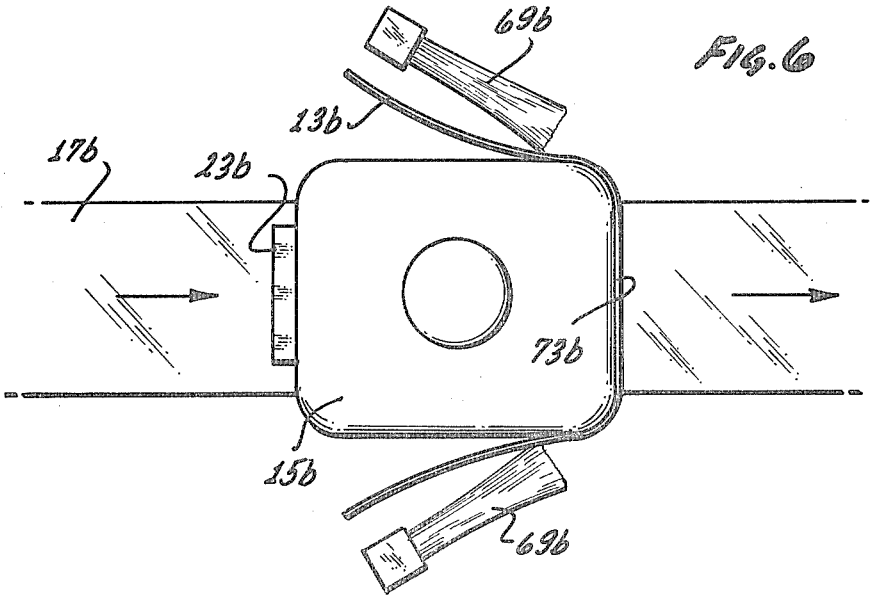
FIG. 6 is a plan view showing the use of brushes to complete the label application operation.

FIG. 6 shows flexible brushes 69*b* for urging the regions of the label 13*b* against the sides of an article 15*b*. The label 13*b* was previously applied to the leading face 73*b* in the same manner as shown in FIG. 5. The brushes 69*b* can be used in lieu of the rollers 69*a* or the rotary elements 69.

Figure 7:
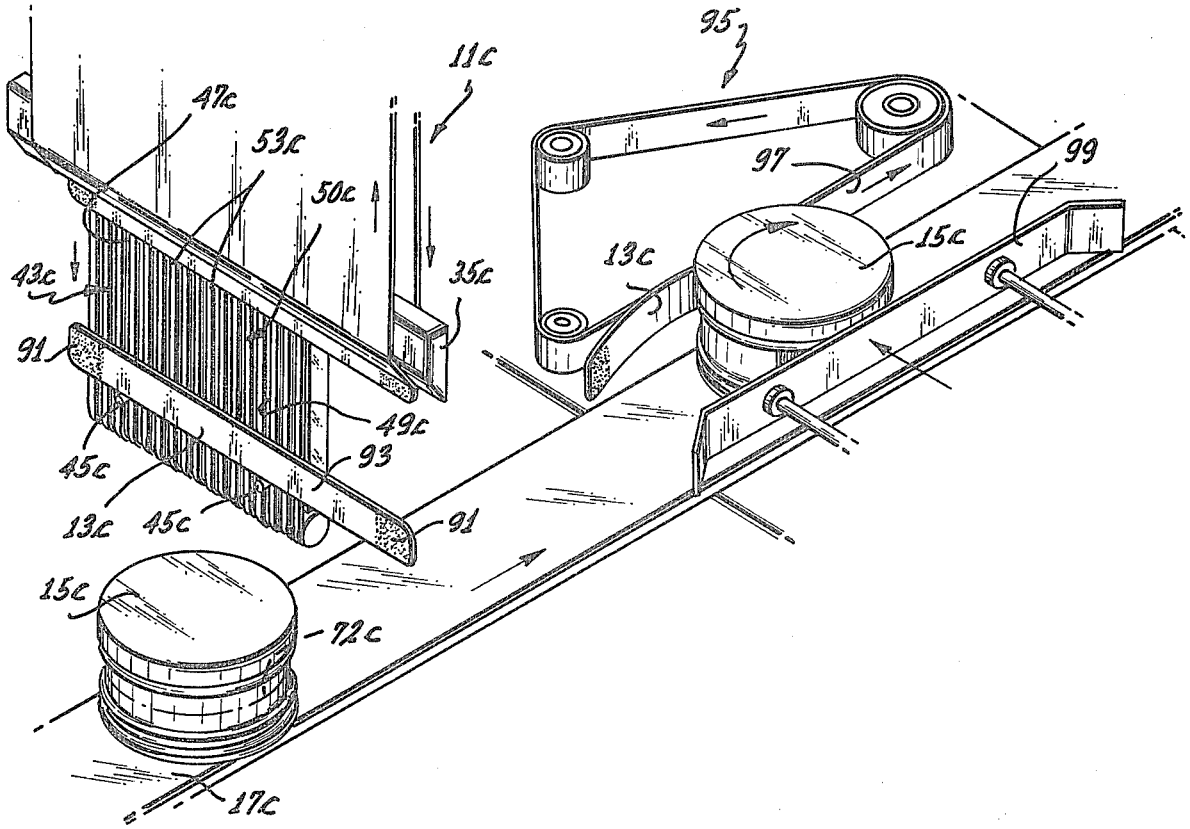
FIG. 7 is a perspective view of a third embodiment of label applicator.

FIG. 7 shows a label applicator 11*c* which is identical to the label applicator 11 in all respects not shown or described above. Portions of the structure shown in FIG. 7 corresponding to portions of the struction shown in FIGS. 1–4 are illustrated by corresponding reference numerals followed by the letter "c."

The label applicator 11*c* is particularly adapted for applying wrap around labels which have adhesive 91 only at their end portions so that the central portion of the label 13*c* cannot be directly adhered to the article 15*c*.

One difference between the label applicators 11*c* and 11 is that, with the former, the conveyor 43 has no space 51, the conveyor sections 47*c*, 49*c* and 50*c* are of the same length, and the conveyor 43*c* is mounted entirely to one side of the article path. Thus, the endless belts 53*c* are all of the same length, and the conveyor 43*c* is displaced somewhat from the position occupied by the conveyor 43 so that a segment 93 of the label 13*c* at the label retaining station overhangs one end of the conveyor. Accordingly, passage of the article 15*c* through the label retaining station brings about engagement of one end of the label 13*c* with the article and consequent adherence of such one end of the label to the article.

Another difference between the label applicators 11*c* and 11 is that the former eliminates the rotary elements 69 in favor of a standard wrap-around device 95. The device 95 may be of conventional construction and includes an endless wrap belt 97 and a guide 99 for urging the article 15*c* against the wrap belt 97. This causes the wrap belt 97 to rotate the article 15*c* to press the label 13*c* against the article. The label applicator 11*c* relies upon the stop elements 45 to accurately align the longitudinal axis of the label with the reference line on the article 15*c* over which such longitudinal axis is to lie.

Although elemplary embodiments of the invention have been shown and described, many changes, modifications and substitutions may be made by one having ordinary skill in the art without necessarily departing from the spirit and scope of this invention.

I claim:

1. A label applicator for applying adhesive labels to articles which are moved along an article path, said label applicator comprising:

means for releasably retaining a label at a label retaining station in the article path so that the article contacts a central region of the label as the article passes through the label retaining station whereby a central region of the label is adhered to the article and end portions of the label are not adhered to the article;

means along the article path downstream of the retaining means for urging the end portions of the label against the article whereby the label is fully adhered to the article; and said retaining means including a conveyor and means for retaining labels on the conveyor, said conveyor including first and second conveyor sections on opposite sides of the article path spaced apart by said central region of the label for releasably retaining the labels at said first and second conveyor sections, and said label applicator including means for dispensing labels onto said conveyor at a location spaced from the label retaining station, said conveyor transporting the labels dispensed onto the conveyor to the label retaining station.

2. A label applicator as defined in claim 1 including stop means for engaging the label and arresting movement thereof when the label is at said label retaining station.

3. A label applicator as defined in claim 1 wherein said urging means includes first and second rotary elements, each of said rotary elements having a plurality of recesses in its periphery with each of said recesses being adapted to partially receive one of the articles which has been labeled whereby rotation of the first and second rotary elements urges the end portions of the labels against the article.

4. A label applicator as defined in claim 1 wherein said urging means includes first and second flexible elements positioned on opposite sides of the article path.

5. A label applicator as defined in claim 1 wherein said first and second conveyor sections include movable first and second endless belts, respectively, for transporting the labels dispensed onto the conveyor to the label retaining station.

6. A label applicator as defined in claim 5 wherein said label retaining means includes means for applying a differential fluid pressure to the label on the conveyor for retaining the label on the conveyor.

7. A label applicator as defined in claim 6 including stop means for engaging the label and arresting movement thereof irrespective of movement of the first and second endless belts when the label is at said label retaining station.

8. A label applicator for applying labels to articles, said label applicator comprising:

a conveyor including first and second conveyor sections, said first and second conveyor sections being spaced apart sufficiently to allow the article to be labeled to pass therebetween;

label dispensing means for dispensing labels onto said conveyor at a first location; and said conveyor including movable means for moving the label from said first location to a second location at which said label releasably is retained on said first and second conveyor section and spans the space between said first and second conveyor sections.

9. A label applicator as defined in claim 8 including means for applying a differential fluid pressure to the label on the conveyor for retaining the label on the conveyor.

10. A label applicator as defined in claim 9 wherein said movable means includes first and second spaced belts and said label applicator includes a stop element extending between said first and second spaced belts in said first conveyor section for engaging and arresting movement of the label along said first conveyor section.

11. A label applicator as defined in claim 8 wherein said movable means includes first and second spaced belts and said label applicator includes a stop element extending between said first and second spaced belts in said first conveyor section for engaging and arresting movement of the label along said first conveyor section.

12. A label applicator as defined in claim 8 including stop means for engaging the label and arresting movement thereof when the label is at said second location whereby the position of the label at said second location can be accurately determined.

* * * * *